US009615653B1

(12) United States Patent
Anderson

(10) Patent No.: US 9,615,653 B1
(45) Date of Patent: Apr. 11, 2017

(54) HAIR BRUSH/HAIR BAND SYSTEM

(71) Applicant: Andrew C. Anderson, Dunedin, FL (US)

(72) Inventor: Andrew C. Anderson, Dunedin, FL (US)

( * ) Notice: Subject to any disclaimer, the term of this patent is extended or adjusted under 35 U.S.C. 154(b) by 687 days.

(21) Appl. No.: 13/909,264

(22) Filed: Jun. 4, 2013

(51) Int. Cl.
*A45D 24/10* (2006.01)
*A46B 15/00* (2006.01)

(52) U.S. Cl.
CPC ..... *A46B 15/0055* (2013.01)

(58) Field of Classification Search
CPC ..... A47F 7/02; A47F 5/04; A47F 5/05; A45D 24/10; A45D 24/38; A45D 2200/25; A45D 33/26; A45D 33/28; A45D 2024/002; A45D 8/36; A47B 9/14; D06F 57/04; D06F 53/045; A47G 25/0664
USPC ..... 132/147, 148, 150, 219, 212
See application file for complete search history.

(56) References Cited

U.S. PATENT DOCUMENTS 4,140,140 A * 2/1979 Proia ..... A45D 24/10 132/311
D354,874 S * 1/1995 Burch ..... D6/567
6,254,383 B1 * 7/2001 White ..... A61C 7/306 206/820
2005/0274641 A1 * 12/2005 Baranoff ..... B65D 73/0064 206/461
2010/0050352 A1 * 3/2010 Deris ..... A45D 29/20 15/105

* cited by examiner

*Primary Examiner* — Todd E Manahan
*Assistant Examiner* — Brianne Kalach

(57) ABSTRACT

A brush has a brushing section and a handle section. The handle section has a recess with an open exterior end. An axial slot is formed in the handle. A core has an enlarged exterior extension. A plurality of parallel bores extend diametrically through the core at spaced locations. A plurality of elastic hair bands, each in a closed loop, are adapted to be positioned within the parallel bores extending from both sides of the bores. The core with extending hair bands is adapted to be inserted into the recess with the hair bands extending through the slot for selective removal by a user.

5 Claims, 2 Drawing Sheets

HAIR BRUSH/HAIR BAND SYSTEM

BACKGROUND OF THE INVENTION

Field of the Invention

The present invention relates to a hair brush/hair band system and more particularly pertains to supporting hair bands in the hair brush and for dispensing the supported hair bands from the hair brush at the discretion of a user, the brushing, supporting, and dispensing being done in a safe, convenient and economical manner.

SUMMARY OF THE INVENTION

In view of the foregoing disadvantages inherent in the known types of hair accessory systems of known designs and configurations now present in the prior art, the present invention provides an improved hair brush/hair band system. As such, the general purpose of the present invention, which will be described subsequently in greater detail, is to provide a new and improved hair brush/hair band system and method which has all the advantages of the prior art and none of the disadvantages.

To attain this, the present invention essentially comprises a brush. The brush has a brushing section and a handle section. The handle section has a recess with an open exterior end. An axial slot is formed in the handle.

A core has an enlarged exterior extension. A plurality of parallel bores extend diametrically through the core at spaced locations.

A plurality of hair bands is provided. Each hair band is elastic. Each hair band is provided in a closed loop. In this manner the hair bands are adapted to be positioned within the parallel bores extending from both sides of the bores. Also in this manner the core with extending hair bands is adapted to be inserted into the recess with the hair bands extending through the slot for selective removal by a user.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved hair brush/hair band system which has all of the advantages of the prior art hair accessory systems of known designs and configurations and none of the disadvantages.

It is another object of the present invention to provide a new and improved hair brush/hair band system which may be easily and efficiently manufactured and marketed.

It is a further object of the present invention to provide a new and improved hair brush/hair band system which is of durable and reliable constructions.

An even further object of the present invention is to provide a new and improved hair brush/hair band system which is susceptible of a low cost of manufacture with regard to both materials and labor, and which accordingly is then susceptible of low prices of sale to the consuming public, thereby making such hair brush/hair band system economically available to the buying public.

Lastly, another object of the present invention is to provide a hair brush/hair band system for supporting hair bands in the hair brush and for dispensing the supported hair bands from the hair brush at the discretion of a user, the brushing, supporting, and dispensing being done in a safe, convenient and economical manner.

These together with other objects of the invention, along with the various features of novelty which characterize the invention, are pointed out with particularity in the claims annexed to and forming a part of this disclosure.

For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various Figures.

DESCRIPTION OF THE PREFERRED EMBODIMENT

Figure 1:
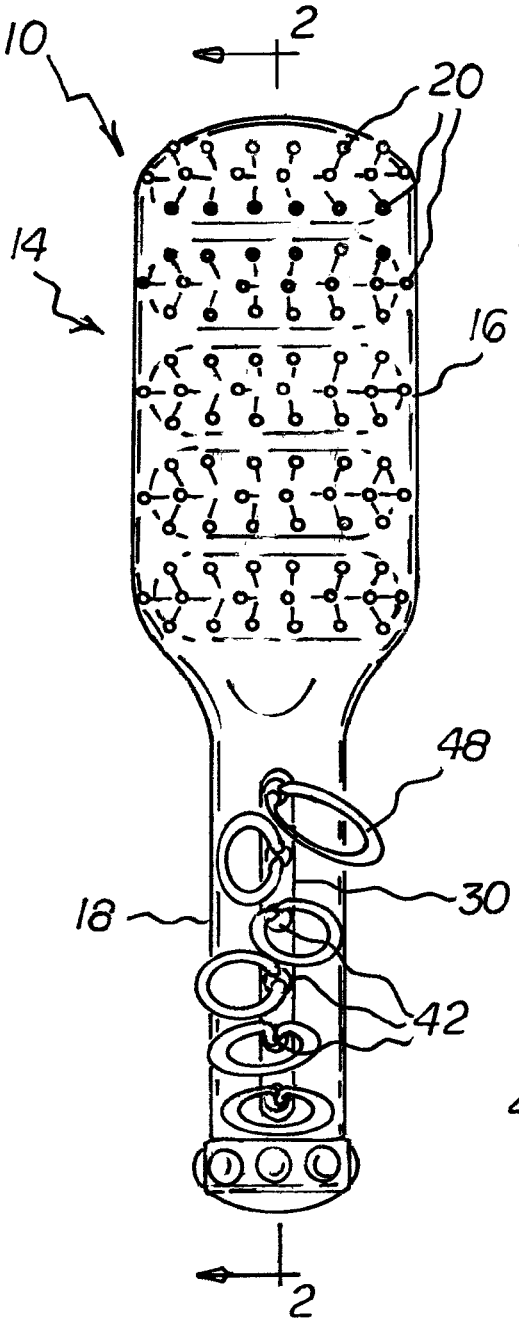
FIG. 1 is a front elevational view of a hair brush/hair bands system constructed in accordance with the principles of the present invention.
Figure 2:
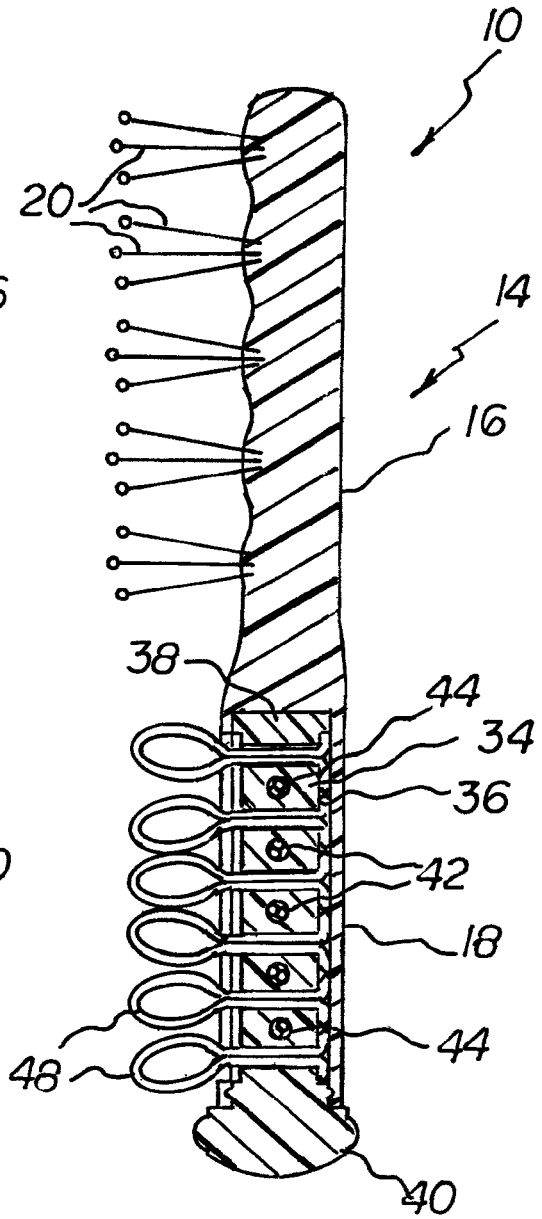
FIG. 2 is a cross sectional view taken along line 2-2 of FIG. 1.
Figure 3:
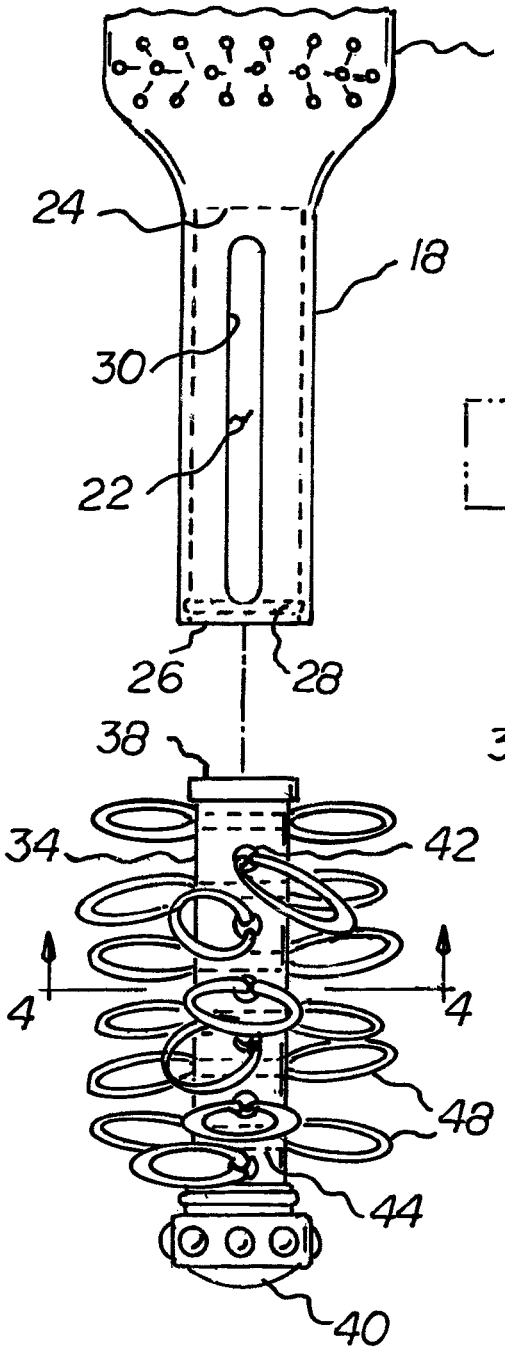
FIG. 3 is an enlarged exploded view of the handle and core and hair bands shown in FIGS. 1 and 2.
Figure 4:
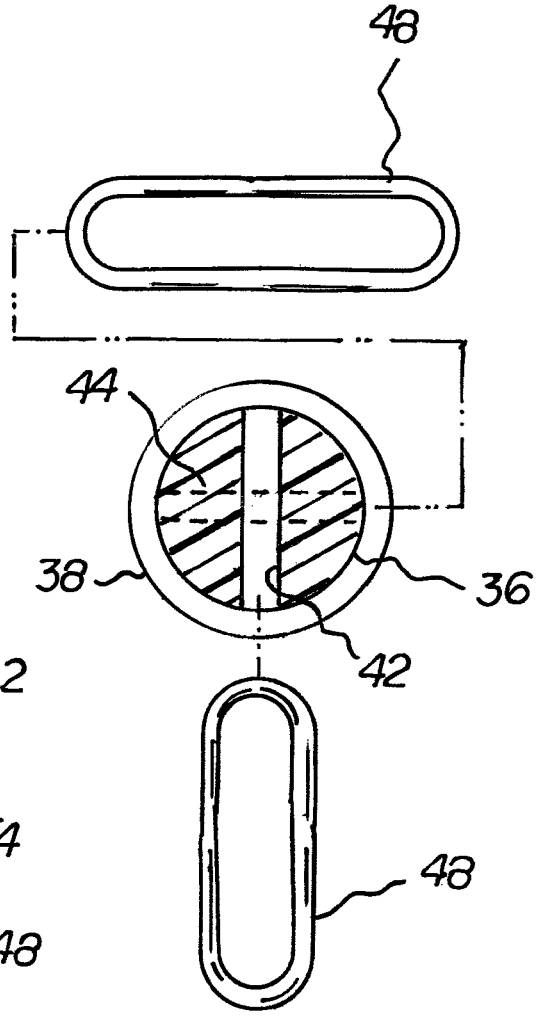
FIG. 4 is an exploded cross sectional view taken through line 4-4 of FIG. 3, the hair bands being shown separated from the core.

With reference now to the drawings, and in particular to FIG. 1 thereof, the preferred embodiment of the new and improved hair brush/hair band system embodying the principles and concepts of the present invention and generally designated by the reference numeral 10 will be described.

The present invention, the hair brush/hair band system 10 is comprised of a plurality of components. Such components in their broadest context include a brush, a cylindrical core, and a plurality of hair bands. Such components are individually configured and correlated with respect to each other so as to attain the desired objective.

First provided is a brush 14. The brush has a brushing section 16. The brush has a handle section 18. The brushing section has a functional side. The functional side has outstanding bristles 20. The outstanding bristles are adapted for movement by a user through hair to be brushed. The handle section has a cylindrical recess 22. The cylindrical recess has a closed interior end 24. The interior end is adjacent to the brushing section. The cylindrical recess has an open exterior end 26. The open exterior end is remote from the brushing section. The cylindrical recess has a first diameter and a first length with a central axis. The cylindrical recess has female screw threads 28. The female screw threads are adjacent to the exterior end. The handle has an axial slot 30. The axial slot is on the functional side for the majority of the length of the cylindrical recess.

Further provided is a cylindrical core 34. The cylindrical core has a second length. The second length is essential equal to the first length. The cylindrical core has a central extent 36. The central extent is over the majority of the second length. The central extent has a second diameter. The cylindrical core has an enlarged interior end 38. The interior end has a third diameter. The third diameter is between 97 percent and 99 percent of the first diameter. The cylindrical core has an enlarged exterior extension 40. The exterior extension has a fourth diameter. The fourth diameter is greater than the first diameter. The core has a plurality of primary bores 42. The bores extend diametrically through the core at equally spaced locations along the length of the core. The core has a plurality of secondary bores 44. The secondary bores extend diametrically through the core at equally spaced locations along the length of the core intermediate the primary bores and transverse with respect there through. The bores have a fifth diameter.

Provided last is a plurality of similarly configured hair bands 48. Each hair band is elastic. Each hair band is formed in a closed loop. Each loop has a circumference of between 5 and 7 times greater than the second diameter. Each loop has a circular cross sectional configuration. Each loop has a sixth diameter. The sixth diameter is between 40 percent and 50 percent of the fifth diameter. In this manner the hair bands are adapted to be positioned within the bores. The hair bands extend from both sides of the bores. The sixth diameter is between 90 percent and 99 percent of the difference between the second diameter and third diameter. In this manner the core with extending hair bands may be inserted into the recess with the hair bands extending through the slot for selective removal by a user when brushing hair.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A hair brush/hair bands system comprising:

a brush having a brushing section and a handle section, the handle section being formed with a recess with an open exterior end, an axial slot formed in the handle;

a core having an enlarged exterior extension, a plurality of parallel bores extending diametrically through the core at spaced locations; and a plurality of hair bands, each hair band being elastic and formed in a closed loop whereby the hair bands are adapted to be positioned within the parallel bores extending from both sides of the bores and whereby the core with extending hair bands is adapted to be inserted into the recess with the hair bands extending through the slot for selective removal by a user.

2. The system as set forth in claim 1 wherein the core has an interior end with an enlarged diameter for forming an annular region between the core and the recess.

3. The system asset forth in claim 1 wherein the core is cylindrical.

4. The system as set forth in claim 3 and further including a plurality of supplemental bores extending through the core transverse to and intermediate of the parallel bores.

5. A hair brush/hair bands system (10) for brushing hair, for supporting hair bands in the hair brush and for dispensing the supported hair bands from the hair brush at the discretion of a user, the brushing, supporting and dispensing being done in a safe, convenient and economical manner, the system comprising, in combination:

a brush (14) having a brushing section (16) and a handle section (18), the brushing section having a functional side formed with outstanding bristles (20), the outstanding bristles adapted for movement by a user through hair to be brushed, the handle section being formed with a cylindrical recess (22), the cylindrical recess having a closed interior end (24) adjacent to the brushing section, the cylindrical recess having an open exterior end (26) remote from the brushing section, the cylindrical recess having a first diameter and a first length with a central axis, the cylindrical recess having female screw threads (28) adjacent to the exterior end, an axial slot (30) in the handle on the functional side for the majority of the length of the cylindrical recess;

a cylindrical core (34) having a second length essential equal to the first length, the cylindrical core having a central extent (36) over the majority of the second length with a second diameter, the cylindrical core having an enlarged interior end (38) with a third diameter between 97 percent and 99 percent of the first diameter, the cylindrical core having an enlarged exterior extension (40) with a fourth diameter greater than the first diameter, a plurality of primary bores (42) extending diametrically through the core at equally spaced locations along the length of the core, a plurality of secondary bores (44) extending diametrically through the core at equally spaced locations along the length of the core intermediate the primary bores and transverse with respect there through, the bores having a fifth diameter; and a plurality of similarly configured hair bands (48), each hair band being elastic and formed in a closed loop, each loop having a circumference of between 5 and 7 times greater than the second diameter, each loop having a circular cross sectional configuration with a sixth diameter between 40 percent and 50 percent of the fifth diameter whereby the hair bands are adapted to be positioned within the bores extending from both sides of the bores, the sixth diameter being between 90 percent and 99 percent of the difference between the second diameter and third diameter whereby the core with extending hair bands may be inserted into the recess with the hair bands extending through the slot for selective removal by a user when brushing hair.

* * * * *